US005987686A

United States Patent [19]

Lane

[11] Patent Number: 5,987,686

[45] Date of Patent: Nov. 23, 1999

[54] VACUUM FLOOR BRUSH CLEANER

[76] Inventor: Michael Steven Lane, 615 Syracuse St., Colorado Springs, Colo. 80911

[21] Appl. No.: 09/039,250

[22] Filed: Mar. 16, 1998

[51] Int. Cl.[6] ..... A46B 17/06

[52] U.S. Cl. ..... 15/142; 15/160

[58] Field of Search ..... 15/38, 39, 104.92, 15/142, 238, 257.05, 257.06, 160, 161, 237

[56] References Cited

U.S. PATENT DOCUMENTS

| | | | |
|---|---|---|---|
| 787,201 | 4/1905 | Martucci | 15/142 |
| 883,752 | 4/1908 | Spicer | 15/142 |
| 2,159,176 | 5/1939 | Nelson | 15/142 |
| 2,604,377 | 7/1952 | Eames | 15/238 |
| 2,724,856 | 11/1955 | Conkey | 15/142 |
| 2,977,620 | 4/1961 | Nilsson | 15/142 |
| 3,729,764 | 5/1973 | Vines | 15/257.06 |
| 4,099,286 | 7/1978 | Ishikawa | 15/142 |
| 4,387,477 | 6/1983 | Eisenberg | 15/104.92 |
| 5,204,159 | 4/1993 | Tan | 15/238 |
| 5,687,444 | 11/1997 | Hakker | 15/142 |

FOREIGN PATENT DOCUMENTS

| | | | |
|---|---|---|---|
| 94/10875 | 5/1994 | WIPO | 15/104.92 |

*Primary Examiner*—Randall E. Chin
*Attorney, Agent, or Firm*—Dennis W. Beech

[57] ABSTRACT

The vacuum floor brush cleaner is generally in the form of a rectangular three sided tray into which a vacuum cleaner brush attachment or floor cleaning unit may be placed or rolled. The bottom inside surface of the tray may have protrusions extending therefrom which engage the brush attachment bristles to remove dirt, hair, thread and other such accumulated debris. The tray may have an adjustable wire bar with protruding wire elements which can be raised and lowered depending on the vacuum cleaner brush attachment. In the case of rotating roller brush units used in floor cleaning units, the wire elements are of a length such that when the wire bar is at the appropriate height the wire elements engage the hard surface of the roller to remove entangled thread and other such debris. Rotating handles and gears as well as levers and gears or cams may be used to raise and lower the wire bar.

4 Claims, 5 Drawing Sheets

VACUUM FLOOR BRUSH CLEANER

BACKGROUND OF THE INVENTION

1. Field of the Invention

This invention relates to devices used to clean the brushes mounted in the floor cleaning attachments and rotating brush floor vacuum units of vacuum cleaners. The present invention may be used to clean hair, lint, carpet fiber, dirt and the like that collect in the bristles of the brushes as well as such material that builds up and becomes entangled around a rotating brush roller.

2. Description of Related Art

There are currently in use various means to clean the brushes of the floor element of a vacuum cleaner. The most common is for the user to simple use the fingers of the hand to clean hair, lint, dirt and carpet fiber from the brushes. In the instance of thread, hair or fiber wound around a rotating brush roller, the material may be so tightly affixed that resort to aids such as a knife may be necessary to remove such material.

For relatively loose material in the brushes, in those cases where the vacuum cleaner has a suction attachment that may be pressed against the brushes, such suction attachment may be moved over the brushes to suction loose material into the vacuum. This does not work for compacted or tightly wound material in the brushes or around a brush roller.

The present invention includes a primary and secondary set of brush cleaning elements which engage the vacuum cleaner floor brush bristles as well as the rotating brush roller element for such brush bristles when a roller element is present. The primary brush cleaning element is adjustable in height in order to engage the hard surface of the rotating brush roller. The cleaning element is constructed of rigid wire elements in order to engage and remove tightly attached thread and the like from the roller. The secondary brush cleaning element is comprised of short protrusions or wire elements in the bottom of the tray of the brush cleaner. As a vacuum cleaner brush element is pushed or rotated on these secondary brush cleaning element protrusions the dust, hair, thread and the like is knocked out of the vacuum brush bristles.

The brush cleaner tray may just be placed on the floor and a vacuum cleaner floor brush element moved into it for purposes of cleaning. The rotating portion of the vacuum cleaner floor element may be rotated in the tray to clean bristles as well as items entangled against the hard surface of the roller element. Regular use of the brush cleaner will prevent build up of debris on the vacuum brush roller which may then migrate to the bearings of the brush roller element. Removal of such debris helps prevent damage to the bearings or in more extreme cases where roller rotation is inhibited the end caps, main housing or vacuum motor may be damaged.

SUMMARY OF THE INVENTION

One object of the present invention is to clean the bristles of brushes of the floor cleaning unit of a vacuum cleaner. Another object is to clean the rotating brush roller of the floor cleaning unit of a vacuum cleaner.

In accordance with the description presented herein, other objectives of this invention will become apparent when the description and drawings are reviewed.

DESCRIPTION OF THE PREFERRED EMBODIMENT

The vacuum floor brush cleaner has an adjustable primary brush cleaning element to clean to the depth of the bristles of brushes in vacuum cleaner floor cleaning units including engaging the hard surface of a brush rotating roller element. The brush cleaner may also have a fixed secondary brush cleaning element for cleaning the bristles of the brushes in vacuum cleaner floor cleaning units.

Figure 1:
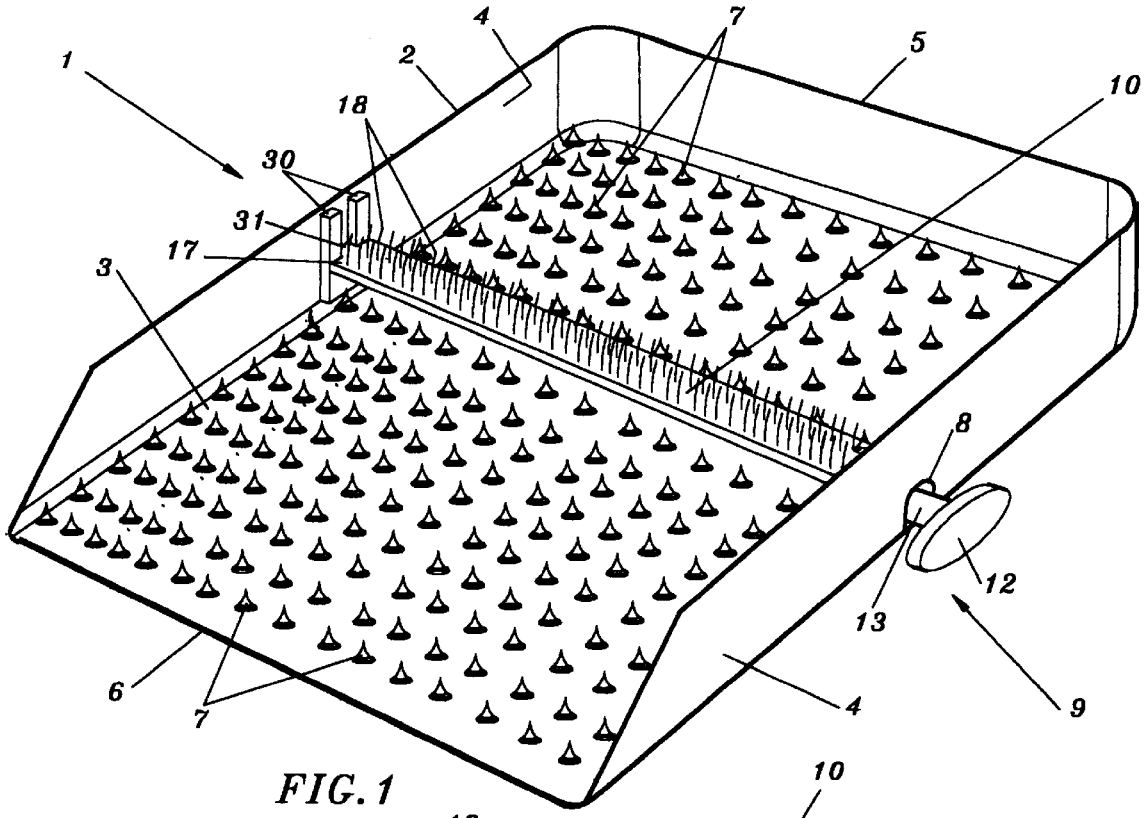
FIG. 1 illustrates a perspective view of the vacuum cleaner brush cleaner with a single primary brush cleaning element.
Figure 2:
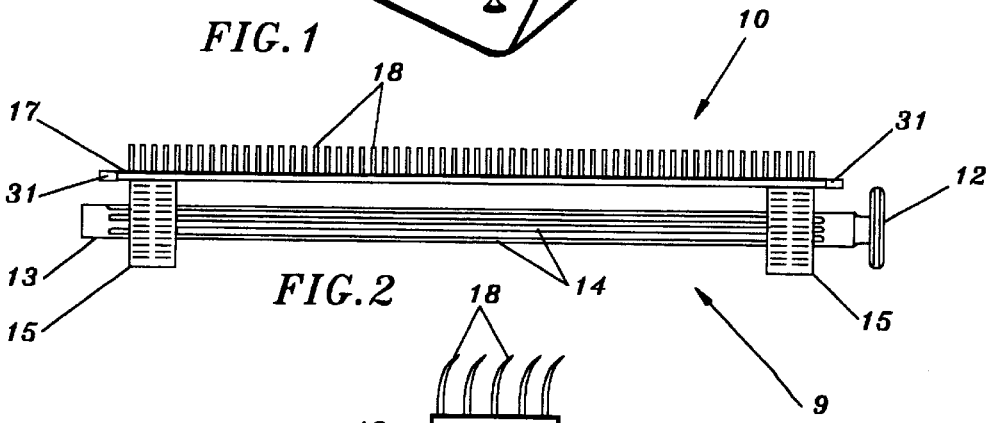
FIG. 2 illustrates a front elevation view of the single primary brush cleaning element.
Figure 2A:
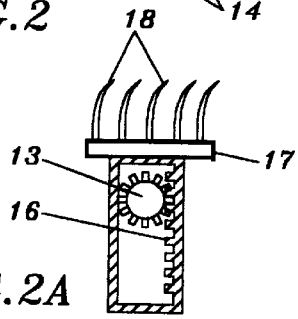
FIG. 2A illustrates a side elevation view of the single primary brush cleaning element.

Referring to FIGS. 1 through 2A, the vacuum floor brush cleaner (1) is formed in the shape of a tray (2) having a bottom (3), two sides (4) and an end (5). The bottom (3) on its inside surface (6) has protrusions (7) or rigid wire elements to provide a secondary brush cleaning element for engaging the bristles of brushes of vacuum cleaner floor cleaning units. These protrusions (7) are selected to provide a length to properly engage the bristles of the brushes for the type of vacuum unit to be cleaned.

In the approximate middle of the two sides (4), apertures (8) are formed to allow the handle (9) of the primary brush cleaning element (10) to be used to adjust the height and horizontal position of the primary brush cleaning element (10) in the tray (2). In the illustrated embodiment, the handle (9) has knob (12) on shaft (13) which has teeth (14). The handle (9) is rotatably and slidably mounted in two pedestals (15) which have racks (16) to engage teeth (14). The pedestals (15) have wire bar (17) attached at the top of each pedestal (15). By turning knob (12) the wire bar (17) may be raised and lowered through operation of teeth (14) in rack (16).

The wire bar (17) is sized to an appropriate length for the type of vacuum cleaner for which it is intended to be used. The wire bar (17) is maintained in proper orientation by guide tabs (31) in guides (30). The rigid wire elements (18) are of a length to engage the bristles and hard surface of a brush rotating roller of a vacuum cleaner floor cleaning unit.

Figure 3:
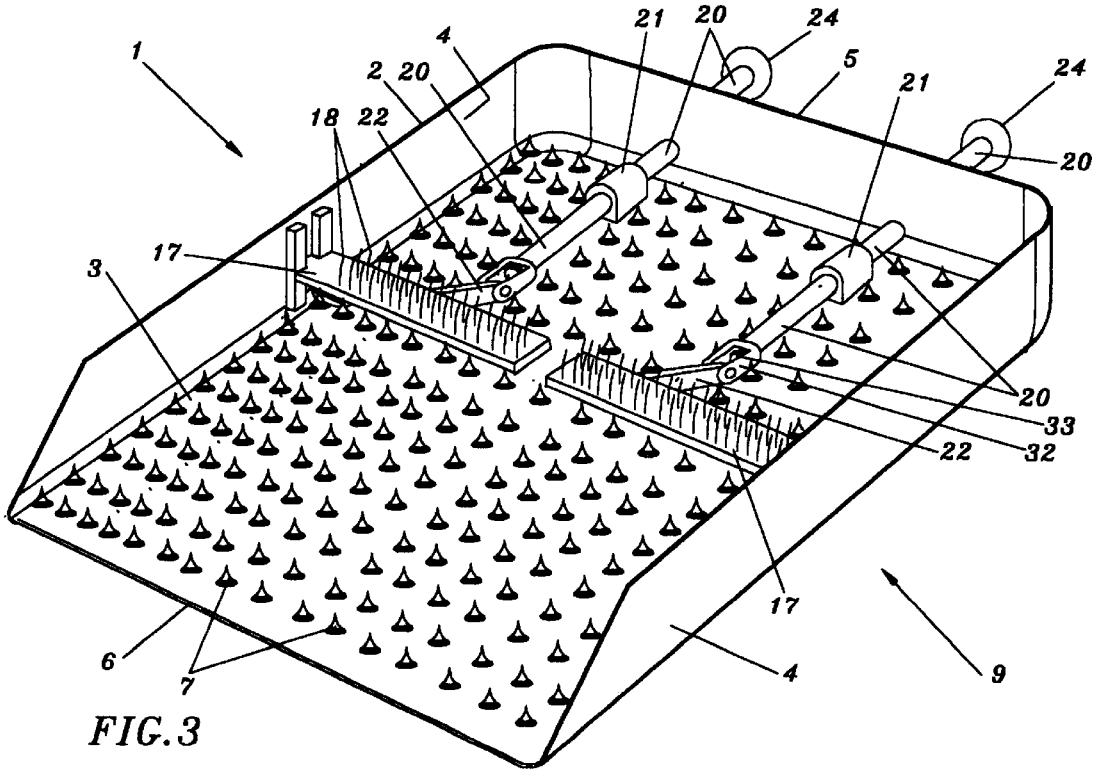
FIG. 3 illustrates a perspective view of the brush cleaner with a two part primary brush cleaning element.
Figure 4:
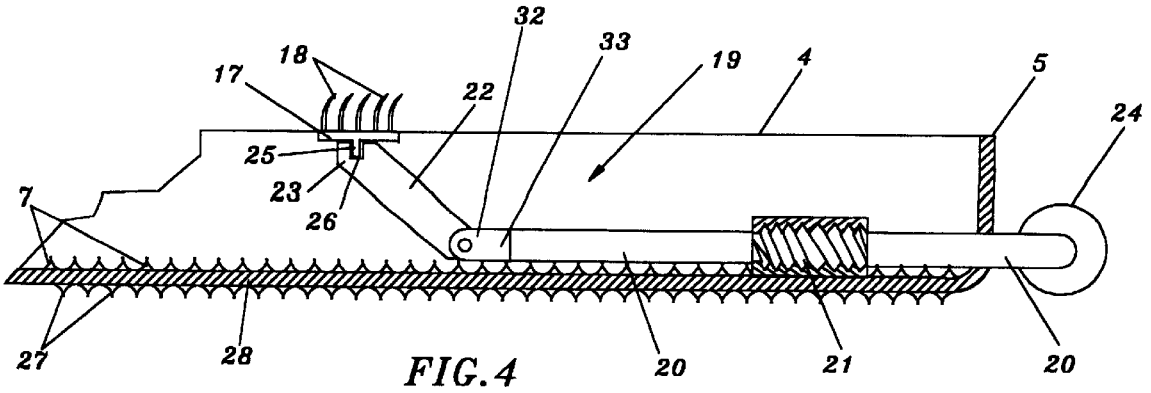
FIG. 4 illustrates a side elevation sectional view of the brush cleaner with one of the two part primary brush cleaning elements exposed.
Figure 5:
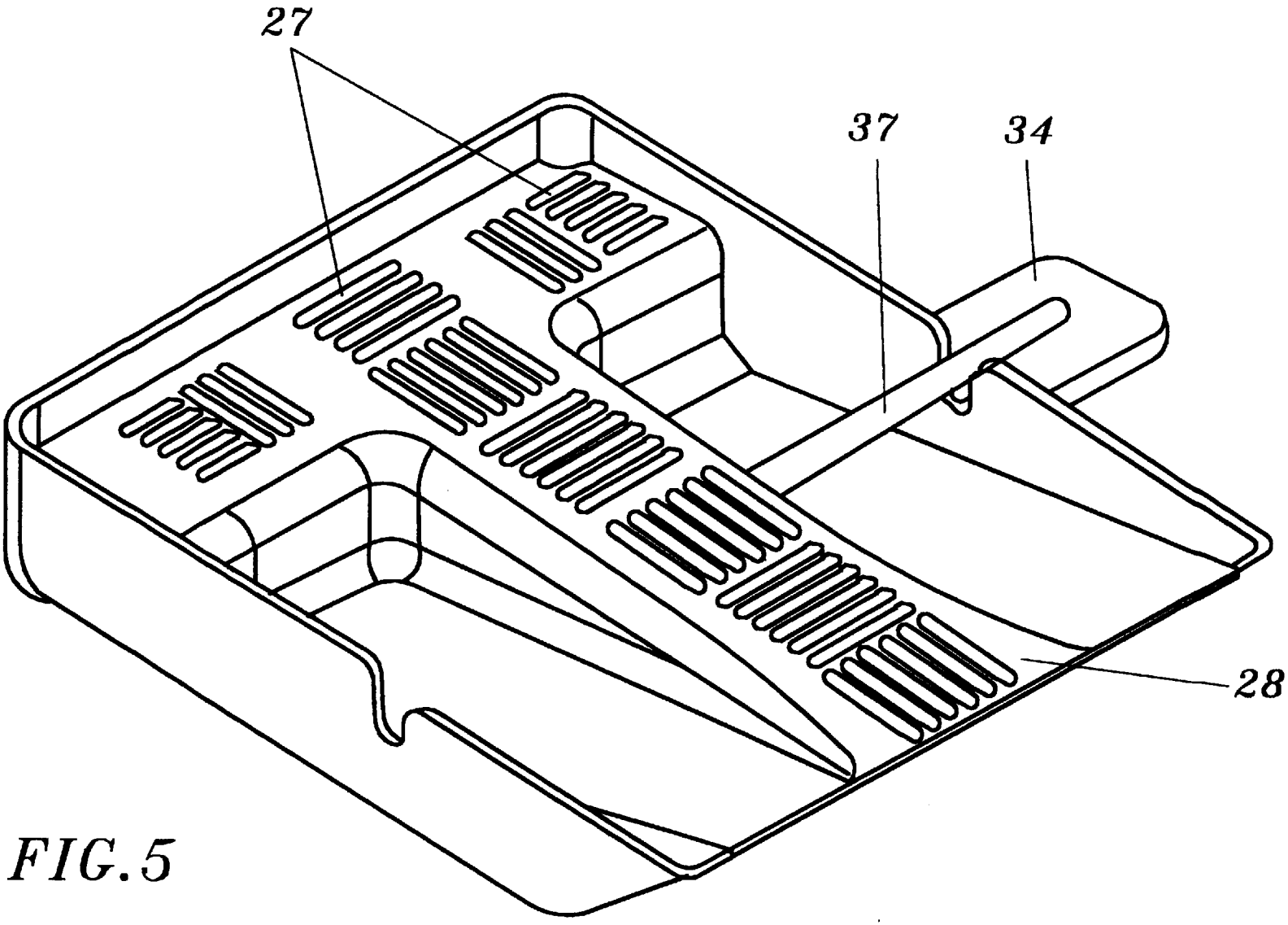
FIG. 5 illustrates a bottom perspective view of the brush cleaner with a foot peddle elevation mechanism.
Figure 6:
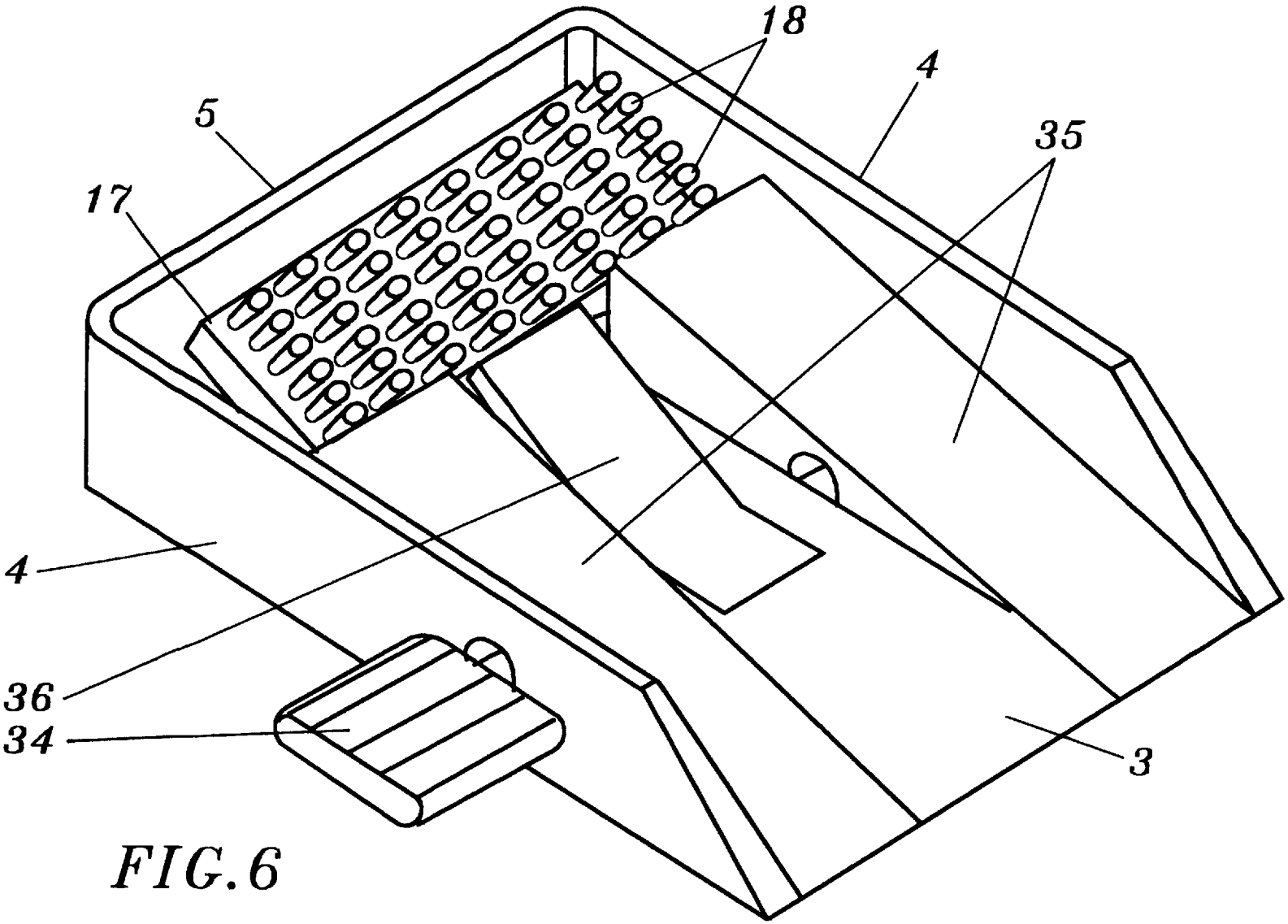
FIG. 6 illustrates a top perspective view of the brush cleaner with a foot peddle elevation mechanism.
Figure 7:
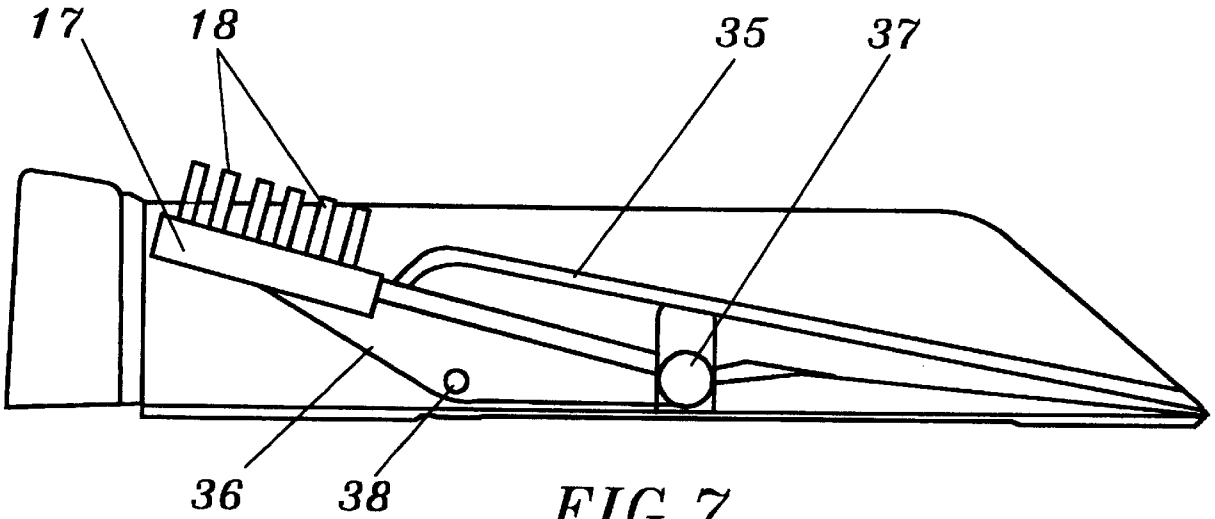
FIG. 7 illustrates a side elevation cross section view of the primary brush cleaning element raised by the foot peddle.
Figure 8:
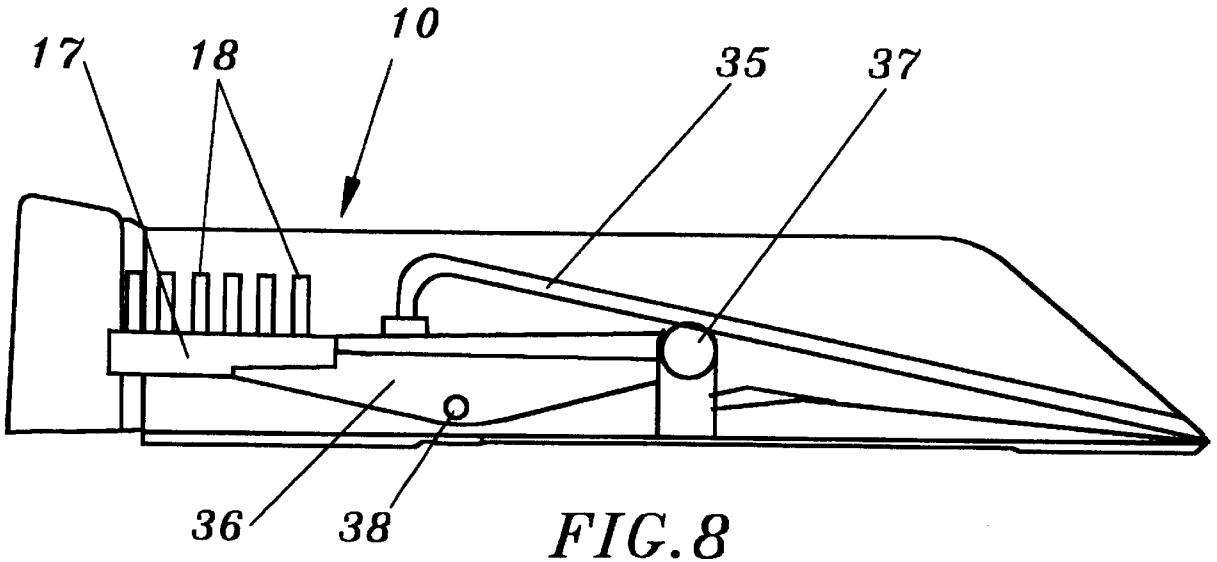
FIG. 8 illustrates a side elevation cross section view of the primary brush cleaning element stored.

Referring to FIGS. 3 and 4, an alternate embodiment of the brush cleaner (1) is illustrated wherein there are two wire bars (17). The tray (2) is of the same general form; however, two height adjustment levers (19) are used to raise and lower the wire bars (17).

The levers (19) rotational elements (20) position is controlled by gears (21). The rotational elements (20) pass through the end (5) and are linked to height levers (22) which support the wire bars (17) at slot end (23). As the rotational elements (20) are turned at elevation knobs (24), the height levers (22) are raised and lowered thereby changing the vertical position of wire bars (17). The rotational motion of the rotational elements (20) are translated to lateral motion by translational joints (32). The rotational elements (20) are retained to the translational joints (32) by lock washers (33).

Wire bars (17) have rails (25) which engage lever slots (26). This retains the wire bars (17) on slot ends (23) and allows the wire bars (17) to be moved horizontally. The wire bars (17) are maintained in proper orientation by guide tabs (31) in guides (30). The use of two wire bars (17) allows for alternate vacuum cleaner brush configurations where for example a support for the vacuum rotating roller brush is in the center of the roller.

Referring to FIG. 4, floor protrusions (27) are illustrated which are mounted to the bottom (3) outside surface (28). Such floor protrusions (27) may be used on carpeting to hold the brush cleaner (1) in place while cleaning a vacuum cleaner floor cleaning unit.

Referring to FIGS. 5 through 8, an alternate embodiment of the brush cleaner (1) is illustrated wherein there is a foot peddle (34) to raise and lower the wire bar (17). The tray (2) is of the same general form; however, two incline ramps (35) are mounted therein to support the vacuum cleaner floor element above the primary brush cleaning element (10).

The wire bar (17) is attached to an elevation lever (36) or pivot beam which is pivotally mounted to the bottom (3). The foot peddle (34) is attached by rod (37) to the elevation lever (36) at the end opposite the wire bar (17). As the foot peddle (34) is pushed down, the elevation lever (36) at the end opposite the wire bar (17). The wire bar (17) may thereby be raised to the desired height to engage a vacuum cleaner floor brush. Again floor protrusions (27) may be used on carpeting to hold the brush cleaner (1) in place.

I claim:

1. A device for cleaning the bristles of the brushes and the brush rotational roller of a vacuum cleaner brush cleaning unit comprising:

a tray of generally rectangular shape having a bottom, two sides and one end;

each side having an aperture defined therein;

a handle comprised of a shaft having a knob at one end and a plurality of teeth attached uniformly radially around the shaft and mounted in the tray and extending through the apertures;

a plurality of pedestals having a rack element slidably mounted on the shaft;

a wire bar with a plurality of wire elements and a pair of guide tabs engaging a guide on the sides attached to the pedestals at their top; and an inside surface of the bottom having a plurality of protrusions mounted thereon.

2. The device as in claim 1 wherein an outside surface of the bottom having a plurality of spikes mounted thereto.

3. A device for cleaning the bristles of the brushes and the brush rotational roller of a vacuum cleaner brush cleaning unit comprising:

a tray of generally rectangular shape having a bottom, two sides and one end;

a wire bar having a plurality of wire elements and a guide tab engaging a guide on the side;

a pair of levers extending through the end of the tray and engaging the wire bars;

the levers comprising a rotational element controlled by a gear and linked by a translation joint to a height lever such that as the rotational element is turned the height lever is raised and lowered;

the height lever having a slot end with a lever slot defined therein such that the wire bar having a rail is slidably retained on the slot end; and an inside surface of the bottom having a plurality of protrusions mounted thereon.

4. The device as in claim 3 wherein an outside surface of the bottom having a plurality of spikes mounted thereto.

* * * * *